US006560785B1

(12) United States Patent
Taguchi

(10) Patent No.: US 6,560,785 B1
(45) Date of Patent: May 13, 2003

(54) VISOR HAVING A RETRACTABLE CAP

(75) Inventor: Jon Taguchi, Portland, OR (US)

(73) Assignee: Nike International Ltd., Beaverton, OR (US)

( * ) Notice: Subject to any disclaimer, the term of this patent is extended or adjusted under 35 U.S.C. 154(b) by 0 days.

(21) Appl. No.: 09/991,120

(22) Filed: Nov. 13, 2001

(51) Int. Cl.[7] ..... A42B 1/06
(52) U.S. Cl. ..... 2/171.1; 2/10; 2/172
(58) Field of Search ..... 2/410, 417, 425, 2/10, 171, 171.03, 171.04, 171.1, 171.4, 171.5, 171.6, 171.7, 171.8, 172, 181, 181.4, 183, 184.5, 209.11, 209.12, 209.3, 175.1, 195.1, 195.2, 195.4, 195.6, 909, 918

(56) References Cited

U.S. PATENT DOCUMENTS 1,105,400 A 7/1914 Burke
1,598,313 A 8/1926 Rosenberg
1,665,750 A * 4/1928 McKee et al. ..... 2/12
3,945,050 A 3/1976 Bohash
4,277,847 A * 7/1981 Florio ..... 2/12
4,556,993 A * 12/1985 Okamura, Sr. ..... 2/12
4,741,053 A * 5/1988 Okamura, Sr. ..... 2/12
4,999,852 A * 3/1991 Murray ..... 2/171.7
5,099,524 A * 3/1992 Linday ..... 2/10
5,685,017 A * 11/1997 Kraft ..... 2/10
5,845,338 A * 12/1998 Clark ..... 2/171.1
6,070,270 A * 6/2000 De La Torre ..... 2/10
6,131,201 A * 10/2000 Chu ..... 2/172
6,209,139 B1 * 4/2001 Schmidt et al. ..... 2/171.1

* cited by examiner

*Primary Examiner*—Gary L. Welch
(74) *Attorney, Agent, or Firm*—Shook, Hardy & Bacon, L.L.P.

(57) ABSTRACT

An article of headgear is provided which includes a pair of flaps that are releasably coupled with one another to form a cap shaped to cover the head of a wearer. The flaps are coupled with the sides of a headband, and a brim extends from the headband.

19 Claims, 2 Drawing Sheets

VISOR HAVING A RETRACTABLE CAP

CROSS-REFERENCE TO RELATED APPLICATIONS

"Not Applicable"

STATEMENT REGARDING FEDERALLY SPONSORED RESEARCH OR DEVELOPMENT

"Not Applicable"

BACKGROUND OF THE INVENTION

The present invention relates generally to an article of headgear and more particularly to a visor having a retractable cap.

Many types of headgear are worn during athletic activities. Headgear having brims or bills to shade sunlight from the wearer's eyes are particular popular for traditional outdoor activities. These activities include baseball, softball, golf, running, cycling and tennis. Also, many people wear this type of headgear during a variety of other activities.

One particularly popular type of headgear is a visor. Visors include a headband extending substantially about the wearer's head and a brim extending from the front of the headband. The crown of the wearer's head is exposed to the outside environment. One advantage of a visor is that heat from the wearer's head is allowed to dissipate to the surrounding environment. Another popular type of headgear is a baseball-style hat having a cap that covers the wearer's head and a brim extending from the cap. The cap protects the wearer's head from the outside elements.

Many people prefer to wear either a visor or a baseball-style hat depending on the weather conditions. For instance, a wearer may prefer to wear a visor when the weather conditions are hot and dry, but prefer a baseball-style cap when the weather conditions are cool and wet. However, since these conditions are unpredictable, and may change over the time that it takes to complete a prolonged activity such as a long run or bike ride, it is desirable to have an article of headgear that serves as both a baseball-style hat and a visor.

Many different types of headgear have been developed in an attempt to offer the advantages of both baseball-style hats and visors. For instance, hats have been constructed with a cap portion that is foldable so that a portion of the wearer's head is exposed to the outside environment. However, when folded, the cap portion is wadded against the crown of the wearer's head. In these type of hats, the cap portion creates a lump in the hat that detracts from the wearer's comfort and the appearance of the hat. Also, the visor must be of sufficient size at one particular side to cover the folded cap portion from view. One example of this type of hat is disclosed in U.S. Pat. No. 4,999,852 to Murray, entitled "Article of Headwear." Alternatively, hats have been constructed that include a support band that is pivoted about the headband of the hat. The cap portion is compressed to one side of the hat when the support band is pivoted. The support band and structure employed to maintain the support band in the desired positions detract from the appearance of the hat. Also, the support band adds unwanted weight to the hat and sometimes presses against the wearer's head. Additionally, the support bands limit the extent to which the hats may be adjusted to fit heads of various size. Examples of these types of hats U.S. Pat. No. 1,665,750 to McKee and Roach, entitled "Cap Attachment for Visors;" U.S. Pat. No. 4,556, 993 to Okamura, Sr., entitled "Convertible Sunvisor Cap;" and U.S. Pat. No. 4,741,053 to Okamura, Sr., entitled "Convertible Sunvisor Cap."

BRIEF SUMMARY OF THE INVENTION

It is an object of the present invention to provide an article of headgear that has a pair of retractable flaps that defines a cap for covering the head of a wearer.

It is another object of the present invention to provide an article of headgear that has at least one flap that is capable of covering the wearer's head and being stored within the headband.

It is a further object of the present invention to provide an article of headgear with a retractable cap which is both comfortable and attractive.

It is yet another object of the present invention to provide an article of headgear with a retractable cap and is adjustable to fit heads of various size.

It is another object of the present invention to provide an article of headgear that is easily converted between a visor and a baseball-style hat.

It is still another object of the present invention to provide an article of headgear with a pair of retractable flaps that are releasably secured to one another by a zipper so that the wearer's head may be fully or partially covered by the flaps.

In accordance with these and other objects evident from the following description of a preferred embodiment of the invention, an article of headgear is provided which includes a pair of flaps that are releasably coupled with one another to form a cap shaped to cover the head of a wearer. The flaps are coupled with the sides of a headband, and a brim extends from the headband.

BRIEF DESCRIPTION OF THE DRAWINGS

The following description of the drawings, in which like reference numerals are employed to indicate like parts in various views.

DETAILED DESCRIPTION OF THE INVENTION

Figure 1:
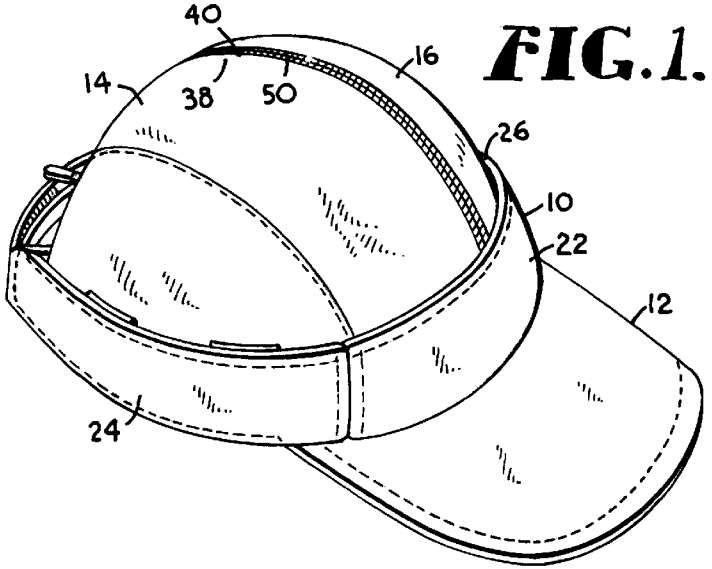
FIG. 1 is a top perspective view of an article of headgear of the present invention with the flaps forming a cap to cover the wearer's head.
Figure 2:
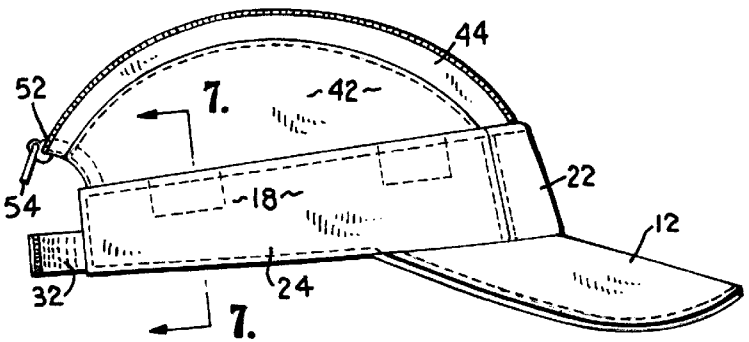
FIG. 2 is a side elevational view of the headgear of FIG. 1.

With initial reference to FIG. 1, an article of headgear constructed in accordance with the preferred embodiment of the present invention broadly includes a headband assembly 10, a brim 12 and a pair of flaps 14 and 16 extending from the headband assembly.

Figure 6:
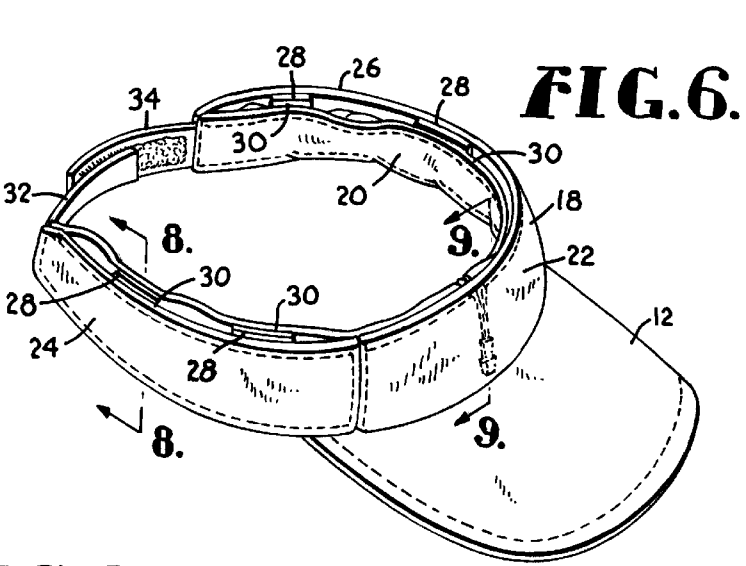
FIG. 6 is a top perspective view of the headgear similar to FIG. 1, but illustrating both flaps in the stored position with the zipper slide and zipper tab shown in phantom lines hidden in the headband assembly.
Figure 7:
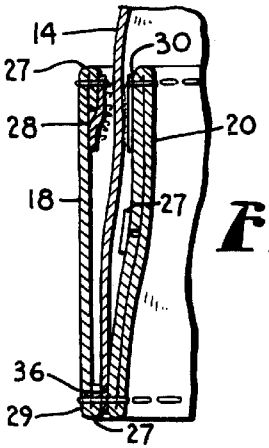
FIG. 7 is a fragmentary sectional view of the headgear taken along line 7—7 of FIG. 2.

As illustrated in FIG. 6, the headband assembly includes an outer headband 18 and an inner headband 20. The outer headband 18 is shaped similarly to a conventional visor headband, and includes a front portion 22 and a pair of opposing sides 24 and 26. In a preferred embodiment, the front portion and opposing sides are separate panels that are sewn to one another. As is apparent, any other sectional or unitary construction is acceptable. The outer headband is preferably made from a flexible synthetic material such as nylon, however, any other suitable covering material will do. As illustrated in FIG. 7, along the upper and lower edges of the outer headband, the material is folded over and sewn to itself to present a pair of smooth edges 27. As illustrated in FIG. 6, a number of rectangular patches 28 of hook fastening material are secured to the interior of the outer headband 18 along its upper edge. The patches may be sewn, adhered or otherwise secured to the headband 18. In a preferred embodiment, two patches 28 are located at a distance from one another on either side 24 and 26 of the outer headband 18 so that a secure connection is made with the inner headband as described below.

The inner headband 20 is preferably made from an absorbent material such as cotton and serves as a sweatband. As illustrated in FIG. 7, the absorbent material is looped over itself and secured at the seam by a small fabric strip 29 sewn to the exterior of the headband 20. The inner and outer headbands are sewn to one another along the lower edge of each headband along a line 29. Inner headband 20 has the same shape as the outer headband 18 and is contiguous with the outer sweatband. Along the exterior of the inner headband 20, a number of rectangular patches 30 of loop (or pile) fastening material are located at positions in alignment with the rectangular patches 28 of the outer headband.

As illustrated in FIG. 6, a pair of adjusting straps 32 and 34 extend from the ends of the headband assembly 10 to complete the band about the wearer's head. In a preferred embodiment, hook fastening material is disposed on the exterior of strap 32, and loop fastening material is disposed on the interior of strap 34 so that the headgear is adjustable to fit heads of differing sizes. As known to those of skill in the art, a variety of other connectors may be utilized to secure the straps to one another. Alternatively, the adjusting straps may be eliminated if headband assembly is extended completely about the wearer's head.

Figure 4:
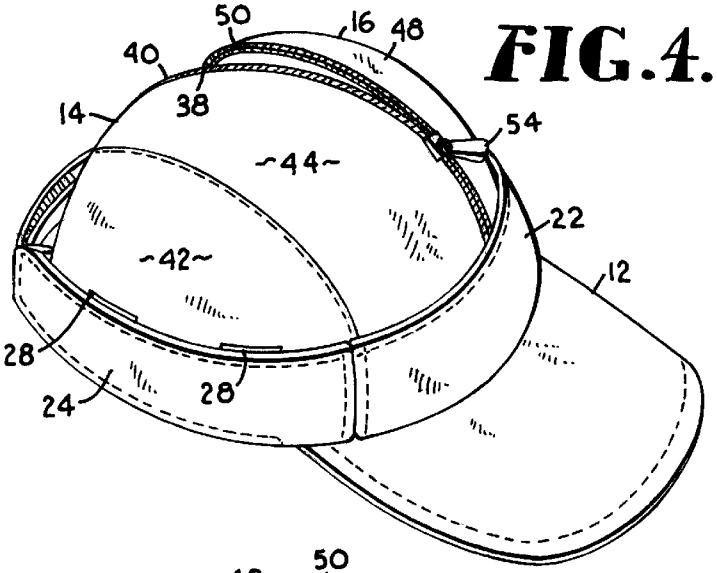
FIG. 4 is a perspective view of the headgear similar to FIG. 1, but illustrating the flaps being disengaged from one another.

The flaps 14 and 16 are preferably made of a nylon material and are movable between a retracted position within the headband assembly and an extended position at which the flaps cover the wearer's head. As illustrated in FIG. 7, flap 14 has an initial edge 36 secured between the outer headband 18 and the inner headband 20. In a preferred embodiment, the edge is positioned between inner and outer headbands at the lower edge and sewn therebetween along the line 29. Alternatively, the flap may be secured to either of the inner and outer headbands at any position between the headbands. The flap is secured between the headbands starting at the end of the headband assembly at which adjusting strap 32 is attached, and ending near the center of the front of the headband assembly as shown in FIG. 4.

As shown in FIG. 1, flap 14 extends from one half of the headband assembly to form a shell that covers one side of the wearer's head. The flap terminates at an edge 38 that is located centrally between the sides 24 and 26 of the outer headband. A row of zipper teeth 40 is located along the terminal edge of the flap for releasably securing the flap 14 to the flap 16 as described below. A small flap (not shown) may overlay the row of teeth when the flaps are secured to one another to obscure the teeth from view.

In a preferred embodiment, the flap 14 includes a first panel 42 secured to the side of the headband assembly and a second panel 44 secured to the front of the headband assembly. When in use, the first panel 42 is angled slightly inwardly with respect to the side 24 of outer headband and mimics the shape of the side of the wearer's head. The second panel 44 is sewn to the edge of the first panel and is generally complementary in shape to the top of a wearer's head.

Figure 3:
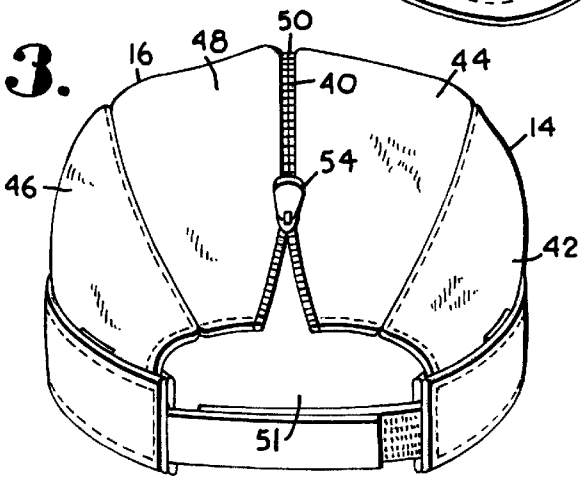
FIG. 3 is a rear perspective view of the headgear of FIG. 1.

Flap 16 is constructed similarly to flap 14. As illustrated in FIG. 3, a first panel 46 is secured to the side of the headband assembly and a second panel 48 is secured to the front of the headband assembly. The two panels form a shell to cover the other side of the wearer's head. A second row of zipper teeth 50 is located at the terminal edge of the flap 16. A small flap (not shown) may overly the row of teeth to cover the teeth when the cap is covering the wearer's head. A zipper slide 52 moves along rows of teeth 40 and 50 to releasably secure flaps 14 and 16 to one another. An opening 51 is defined between the flaps 14 and 16 and the straps 32 and 34, when the flaps are secured to one another. This space allows the wearer to adjust the size of the headband assembly.

Figure 9:
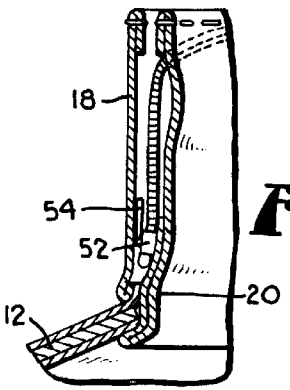
FIG. 9 is a fragmentary sectional view of the headgear taken along line 9—9 of FIG. 6 illustrating the location of the zipper slide and zipper tab in the stored position.

As illustrated in FIGS. 6 and 9, the brim 12 is of conventional construction and is secured to the front portion 22 of the outer headband. The brim is curved about its edges to prevent sun exposure to the wearer's eyes. In a preferred embodiment, the brim is sewn between the outer headband 18 and inner headband 20.

In use, as illustrated in FIG. 1, the flaps 14 and 16 are initially coupled with one another along the rows of zipper teeth 40 and 50 so that the headgear is in the form of a baseball-style hat. The flaps 14 and 16 define a cap that protects the wearer's head from exposure to the surrounding conditions. When the wearer desires to retract the cap, as illustrated in FIG. 3, the tab 54 on the zipper slide 52 is grasped and pulled toward the front of the headband assembly 10. As shown in FIG. 4, the flaps 14 and 16 are disengaged from one another as the slide is pulled. When the slide 52 is pulled to a position between the lower edges of the outer headband 18 and inner headband 20 as shown in FIG. 9, the flaps are released from one another.

Figure 5:
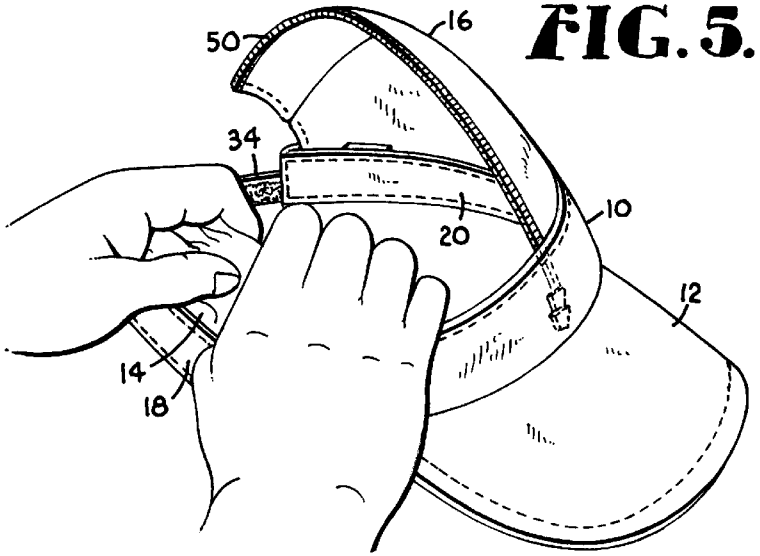
FIG. 5 is a top perspective view of the headgear illustrating one of the flaps being folded and placed between the outer and inner headbands of the headband assembly.
Figure 8:
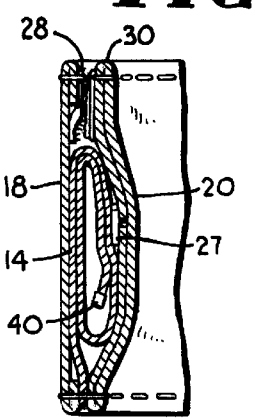
FIG. 8 is a fragmentary sectional view of the headgear taken along line 8—8 of FIG. 6.

As illustrated in FIG. 5, the wearer folds the flap 14 toward the headband assembly until it is sufficiently compact to fit between the pouch defined between the outer headband 18 and inner headband 20. Preferably, with reference to FIG. 4, the second panel 44 is folded over the first panel 42 near the seam between with the two panels so that the exterior surfaces of the panels are facing one another. Next, the flap is grasped near the seam, and repeatedly folded or rolled until the flap is located within the pouch between the outer and inner headbands. Alternatively, the flap may be placed within the headband assembly by employing one of a variety of other techniques. For instance, rather than folding the second panel over the first panel, the entire flap may be folded or rolled in the direction of the inner headband and stored within the pouch between the outer and inner headbands as illustrated in FIG. 8.

Once the flap is located between the headbands, the patches of fastening material 28 and 30 are secured to one another so that the flap 14 is held between the inner and outer headbands as illustrated in FIG. 6. In this position, the flap is not visible when the headgear is placed on a wearer's head. The process is repeated with flap 16. Once both flaps are stored within the headband assembly, the conversion from a baseball-style hat to a visor is complete.

When desired, the wearer may convert the headgear into a baseball-style cap by pulling the patches of fastening material 28 and 30 from one another, and unfolding the flaps 14 and 16. Next, in one simple motion, the wearer pulls the zipper slide 52 rearwardly from the position shown in FIG. 8. As the slide is pulled, the flaps are secured to one another until the cap is defined by the two flaps. If desired, as illustrated in FIGS. 3 and 4, the slide 52 may be positioned so that a portion of the flaps are free and unattached from one another so that additional ventilation is provided to the wearer's head.

By providing an article of headgear in accordance with the present invention, numerous advantages are realized. For example, the flaps are easily folded and stored within the headband assembly. When the flaps are stored within the headband assembly, the flaps are not visible and the headgear looks nearly identical to a conventional visor. The headgear of the present invention does not require any bulky structures for converting the visor to and from a baseball-style cap. Thus, the weight and comfort of the headgear are similar to conventional visors and baseball-style hats. Likewise, the headgear may be adjusted to fit heads of various size without interference by the structure employed to convert the headgear between its two forms. Additionally, the wearer may control the amount of ventilation to the wearer's head by varying the extent to which the flaps are secured to one another.

Although the invention has been described with reference to the preferred embodiment illustrated in the attached drawing figures, it is noted that substitutions may be made and equivalents employed herein without departing from the scope of the invention as recited in the claims. For example, although the preferred embodiment is illustrated and described as having a zipper connection between the two flaps, it is understood that other connectors such as other slide connectors, snaps and hook and loop fasteners may be employed without departing from the present invention.

What is claimed is:

1. An article of headgear comprising:

a headband having a front portion and a pair of opposing sides;

a brim extending from the front portion of the headband, and a pair of flaps having a bottom edge, wherein a substantial portion of the bottom edge of each flap is coupled with one of the sides of the headband, wherein the flaps are releasably coupled with one another at a position between the sides of the headband to define a cap shaped to cover a substantial portion of the head of a wearer.

2. An article of headgear comprising:

a first headband having a front portion and a pair of opposing sides;

a brim extending from the front portion of the first headband;

a pair of flaps coupled with the headband, each flap extending from one of the sides of the first headband; and a second headband coupled with and overlying the first headband, wherein the flaps are releasably coupled with one another at a position between the sides of the first headband to define a cap shaped to cover the head of a wearer, and wherein each flap is capable of being folded and retained between the first and second headbands when the flaps are not secured to one another.

3. An article of headwear as recited in claim 2, wherein each flap is secured between the first and second headbands.

4. An article of headwear as recited in claim 2, wherein each flap has a first edge secured to one of the headbands and a second edge adapted to be releasably coupled with the opposing flap.

5. An article of headwear as recited in claim 4, wherein the second edges of the flaps are releasably secured to one another by a zipper.

6. An article of headwear as recited in claim 4, wherein the flaps are of generally equal size and are releasably secured to one another centrally between the sides of the first headband.

7. An article of headgear as recited in claim 6, wherein each flap includes a first panel generally conforming to a side of the wearer's head and a second panel generally conforming to the top of the user's head.

8. An article of headwear as recited in claim 2, wherein the second headband is a sweatband.

9. An article of headgear as recited in claim 2, wherein the first and second headbands include a lower edge and an upper edge, and wherein the article of headgear further comprises at least one pair of complementary fasteners at the upper edges of the first and second headbands, wherein the fasteners releasably secure the headbands to one another to retain the flaps between the headbands.

10. An article as recited in claim 9, wherein the complementary fasteners are a patch of hook fastening material and a patch of loop fastening material.

11. An article of headgear comprising:

a sweatband;

a headband secured to and overlaying the sweatband;

a brim coupled with and extending from the sweatband;

a first flap coupled with at least one of the sweatband and the headband, and a second flap coupled with at least one of the sweatband and the headband, wherein the flaps are movable between a first position wherein the flaps are releasably coupled with one another to form a cap and a second position wherein each flap is stored between the headband and the sweatband.

12. An article of headgear as recited in claim 11, wherein the flaps are releasably coupled with one another by a zipper when the flaps are in the first position.

13. An article of headgear as recited in claim 11, wherein the flaps are folded when the flaps are in the second position.

14. An article of headgear as recited in claim 11, wherein the sweatband and the headband are releasably secured to one another when the flaps are in the second position to retain the flaps between the headband and the sweatband.

15. An article of headgear as recited in claim 11, wherein the flaps are of equal size.

16. An article of headgear for use by a wearer comprising:

a headband;

a brim coupled with and extending from the headband;

means for covering a first portion of the wearer's head; and means for covering a second portion of the wearer's head, wherein the first and second covering means are movable between an extended position at which the covering means are secured to one another to define a cap and a second position wherein each of the covering means is stored within the headband.

17. An article of headgear as recited in claim 16, wherein the first and second covering means are folded when placed in the second position.

18. An article of headgear as recited in claim 17, further comprising means for securing each covering means within the headband.

19. An article of headgear comprising:

a headband having a pouch extending along at least a portion thereof;

a brim coupled with and extending from the headband, and a flap extending from the headband and having a first position and a second position, wherein the flap in its first position covers at least a portion of a wearer's head and wherein the flap in its second position is stored within the pouch of the headband.

* * * * *